US005586543A

United States Patent [19]

Schnaibel et al.

[11] Patent Number: 5,586,543

[45] Date of Patent: Dec. 24, 1996

[54] MIXTURE CONTROLLER FOR AN INTERNAL COMBUSTION ENGINE

[75] Inventors: Eberhard Schnaibel, Hemmingen; Lothar Raff, Remseck; Klaus Hirschmann, Leonberg, all of Germany

[73] Assignee: Robert Bosch GmbH, Stuttgart, Germany

[21] Appl. No.: 372,937

[22] Filed: Jan. 17, 1995

[30] Foreign Application Priority Data

Jan. 21, 1994 [DE] Germany ..... 44 01 661.1

[51] Int. Cl.[6] ..... F02D 41/14

[52] U.S. Cl. ..... 123/696

[58] Field of Search ..... 123/694, 696

[56] References Cited

U.S. PATENT DOCUMENTS

| | | | |
|---|---|---|---|
| 4,073,269 | 2/1978 | Herth et al. | 123/696 X |
| 4,428,345 | 1/1984 | Bertsch et al. | 123/696 X |
| 4,932,383 | 6/1990 | Zechnall et al. | 123/694 |

*Primary Examiner*—Tony M. Argenbright
*Attorney, Agent, or Firm*—Walter Ottesen

[57] ABSTRACT

A mixture controller for adjusting an output value, which is outputted by a PI two-point controller, to control the air/fuel ratio of a mixture supplied to an internal combustion engine to a pregiven value. The engine produces an exhaust-gas flow during operation and has an oxygen probe mounted in the exhaust-gas flow. The mixture controller continuously detects the signal of the oxygen probe to obtain sequential measurement values of the signal. A check is made as to whether a currently detected measurement value of the signal has crossed over a threshold value in the lean or rich direction compared to the previously detected measurement value of the signal. The output value is changed when a crossover of the signal in the lean direction is present by shifting the output value with a large step via a P-jump in the rich direction and starting an integration of the output value in the rich direction from a previous lean direction. The output value is also changed when a crossover of the signal in the rich direction is present by stopping the integration of the output value in the rich direction and starting an integration in the lean direction after a pregiven delay time has elapsed. The operation of the mixture controller is returned to checking after the output value has changed. A return of the operation of the mixture controller to the checking operation is inhibited until an inhibit time has elapsed.

7 Claims, 2 Drawing Sheets

MIXTURE CONTROLLER FOR AN INTERNAL COMBUSTION ENGINE

FIELD OF THE INVENTION

The invention related to a mixture controller for adjusting the output variable outputted by a PI two-point controller. The output variable controls the air/fuel ratio of the mixture to a pregiven value. The mixture is supplied to an internal combustion engine.

BACKGROUND OF THE INVENTION

A threshold value of a measurement variable corresponds to the above-mentioned pregiven value for the air/fuel ratio. When the measurement variable is the output voltage of a Nernst probe and the above-mentioned ratio has the value 1, then the threshold value is approximately 450 mV when the probe voltage is directly evaluated. This threshold value can, for example, be so switched that it corresponds to 0 mV or some other suitable value. What is decisive is that, when the probe voltage lies to one side of the threshold voltage, a mixture enrichment is undertaken via the mixture controller; whereas, in the opposite case, the mixture controller undertakes a leaning. If the voltage of a Nernst probe is evaluated directly, the voltages greater than the threshold value correspond to an absolute rich mixture; whereas, voltages below the threshold value correspond to an absolute lean mixture. The position of the threshold voltage is not too critical in the case of a Nernst probe because the Nernst probe exhibits a very large voltage swing, during the transition from rich to lean and vice versa, in a very narrow range of the mixture composition.

When on average, an internal combustion engine is not driven by a stoichiometric mixture but, for example, with a lean mixture, then the threshold value changes correspondingly in order to obtain a switchover between enriching and leaning in another measurement value range. The terms "rich" and "lean" are used herein in a manner so that they apply relative to the threshold value. When utilizing a Nernst probe and the threshold value is set, for example, to only 100 mV, then a measurement value of 200 mV corresponds already to a lean mixture when viewed absolutely; however, further leaning must be undertaken so that the measurement value drops below the threshold value. For this reason, this state is rich referred to the threshold value.

The measurement value must not necessarily be a voltage; instead, the measurement variable can, for example, also be a current such as when a limit-current probe is used in lieu of a Nernst probe in order to measure the mixture composition. The probes can exhibit a high nonlinearity between the content of the oxygen in the mixture and the measurement value as with Nernst probes; or, the relationship can be quite linear as with limit-current probes. The greater the nonlinearity of the relationship, the more intensely do the measures according to the invention become effective.

A mixture controller having a PI characteristic can be utilized with a multi-cylinder internal combustion engine. With this use, the observation can be made that the probe voltage oscillates at a higher frequency than would be expected by the coaction of the PI characteristic and the dead time of the control loop. The dead time is caused, for example, by the transit time of the fuel/air mixture to travel from the intake pipe, be combusted in the engine cylinders and finally arrive at the probe in the exhaust gas output pipe. This effect is characterized as "chemical noise" in U.S. Pat. No. 4,932,383 and is attributed to variations in the composition of the mixture from cylinder to cylinder of the multi-cylinder engine. When various cylinders of an engine are supplied with slightly different mixtures, then the exhaust gas from one of the cylinders can, for example, be slightly lean, whereas, the exhaust gas from another cylinder can still be slightly rich. The measurement value then jumps multiple times above and below the threshold value within a short time interval. Each time, this then immediately triggers a P-jump when a transition from rich to lean is determined. In this way, the output variable can be shifted in an unwanted manner in the lean direction in a very short time. A similar difficulty occurs when a delay time has elapsed after a transition from lean to rich. In all cases, unwanted P-jumps lead to unwanted large control deviations of the mixture composition. SUMMARY OF THE INVENTION It is an object of the invention to provide a mixture controller for an internal combustion engine which controls the composition of the air/fuel mixture with very slight control deviations.

According to a first embodiment of the invention, a pregiven inhibit time must have elapsed after a first P-jump before a further P-jump is possible in the same direction. According to a second embodiment, a check is made when a delay time has elapsed which had been started when the probe measurement value crossed over the initially-mentioned threshold value in a pregiven direction. This check is as to whether the measurement value still lies on the same side of the threshold voltage as after crossover or not. If this threshold lies on the other side, then no P-jump is triggered.

According to a third embodiment, if the measurement value lies on the same side when the just-mentioned delay time has elapsed, but has been disposed for the greater part of the delay time on the other side, likewise no P-jump is triggered.

In all three embodiments, the technical concept is the same, namely, that a pregiven time span is utilized in order to decide whether a P-jump is to be permitted or not.

BRIEF DESCRIPTION OF THE DRAWINGS

The invention will now be described with reference to the drawings wherein:

FIG. 2A more specifically shows the curves for transition from rich to lean and FIGS. 2B and 2C show the transition from lean to rich. In the case of FIG. 2B, the rich mixture is still present after a delay time has elapsed and, in contrast, in the case of FIG. 2C, a lean mixture is again present; and, FIG. 3 is a flowchart for explaining the operation of the mixture controller of FIG. 1.

DESCRIPTION OF THE PREFERRED EMBODIMENTS OF THE INVENTION

Figure 1:
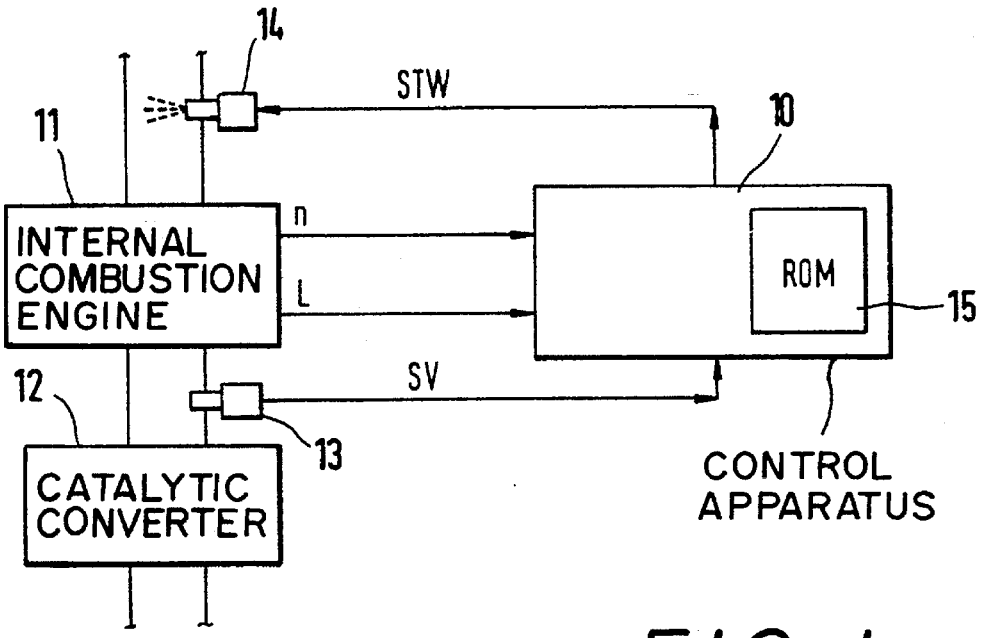
FIG. 1 is a block circuit diagram showing how the mixture controller according to the invention and an internal combustion engine coact with each other.

FIG. 1 shows a control apparatus 10 of an internal combustion engine 11 wherein the control apparatus 10 operates as a mixture controller according to the invention. A catalytic converter 12 is mounted in the exhaust gas flow of the engine 11. The oxygen content of the exhaust gas is measured by an oxygen probe 13 which supplies its output signal SV to the control apparatus 10. The control apparatus 10 processes the measurement value received in accordance with a specific algorithm and outputs an output value STW to a fuel-injection device 14. A read-only-memory (ROM) 15 is disposed in the control apparatus 10 and a program is stored in the ROM 15 which imparts the function of the mixture controller according to the invention to the control apparatus as will be explained in greater detail with respect to FIG. 3.

The mixture controller according to the invention exhibits its advantages most clearly when it coacts with a Nernst probe as an oxygen probe 13 and controls to provide a stoichiometric mixture. In the region about the stoichiometric mixture, the output voltage of a Nernst probe exhibits a very great dependency upon the mixture composition. Accordingly, the smallest changes of the mixture composition are sufficient so that the probe voltage crosses over its threshold value TH several times within a short time span.

The mixture controller according to the invention prevents such crossovers from operating negatively on the control performance of the mixture controller. Such multiple crossovers between the measurement value and the threshold value take place fewer times within a short time span if probes having a more linear performance between the mixture composition and the measurement value outputted by the probes are used. However, such crossovers cannot be excluded entirely so that the mixture controller according to the invention also leads to an advantage in such cases.

Figures 2A, 2B, 2C:
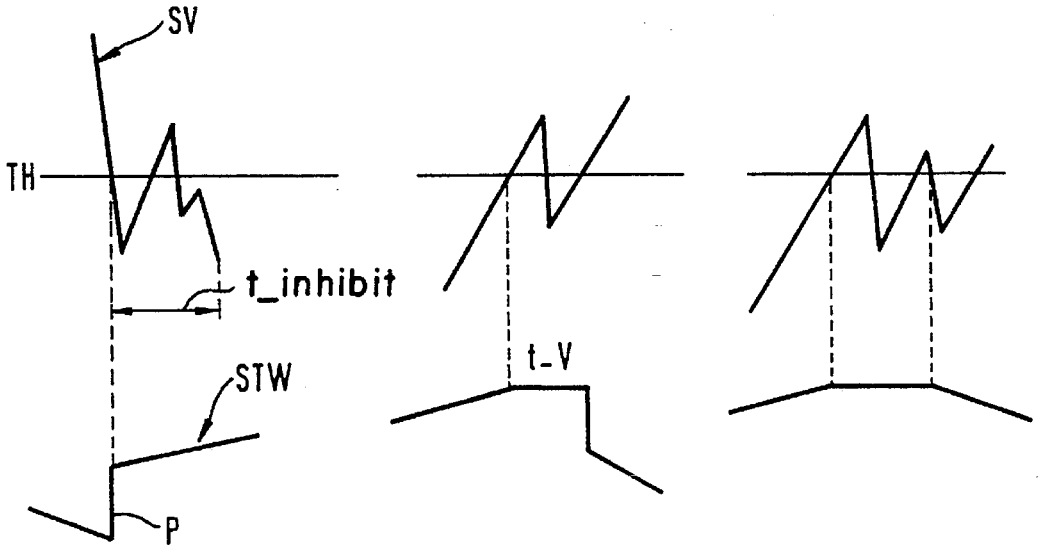
FIGS. 2A to 2C show schematic representations of the time-dependent trace of the voltage of a Nernst probe and, directly therebelow, the corresponding trace of the output variable of a mixture controller.

In each of FIGS. 2A, 2B and 2C, the probe measurement value SV crosses over the threshold value TH several times within a short time span such as several hundred milliseconds. In the case of FIG. 2 the first crossover is from rich to lean. This first crossover triggers a P-jump in the direction of rich. According to the invention, an inhibit time t_inhibit is triggered within which no further P-jump is permitted. In the embodiment shown, the probe measurement value SV crosses over the threshold value within the inhibit time from lean to rich and again from rich to lean. Previous mixture controllers, which have no inhibit time, would stop the integration of the output value with a crossover from rich to lean as will be explained below with respect to FIG. 2B and, for a next crossover from rich to lean, the mixture controller would trigger a new P-jump which would shift the output value relatively far into the lean region.

A multiple crossover between the probe measured value and the threshold value is especially probable within a short time span after the first crossover after a longer time span. Accordingly, after the first crossover, the above-mentioned inhibit time is triggered. When this inhibit time has elapsed, the probe measured value is, as a rule, so far from the threshold value that even with further fluctuations of the probe measured value, a crossover at the threshold value is improbable. It should be noted that the total time-dependent trace is dependent upon the control frequency of the mixture controller which, in turn, is dependent upon the rpm and the load of the internal combustion engine 11. Preferably, the inhibit time is approximately 20 to 25% of the length of the period of the control oscillation. At idle, the period has a duration, for example, of a few seconds. Correspondingly, the inhibit time in this case is several hundred ms.

FIG. 2B shows a case wherein the first of several sequential crossovers between the probe measurement value and the threshold value is from lean to rich. At the time point of the crossover, a delay time t_V is triggered within which no P-jump in the direction of lean takes place as known per se. This causes a slight shift of the mixture in the direction rich compared to that composition as it corresponds actually to the pregiven threshold value. The controller according to the invention utilizes two additional further measures compared to previous controllers. The one measure is that, as can be seen in FIG. 2B, no P-jumps are permitted during the delay time notwithstanding several crossovers. The second measure can be seen from a comparison of FIGS. 2B and 2C. The mixture controller according to the invention checks whether the mixture is still at rich or again at lean with the elapse of the delay time. If the mixture is still in rich, a P-jump in the direction of lean is triggered and the integration in the direction of lean is started, that is, measures are taken which correspond to those of conventional mixture controllers with the elapse of the delay time. If in contrast, the mixture is lean with the elapse of the delay time, then no P-jump is triggered; instead, only the integration of the output value in the direction of lean takes place.

Figure 3:
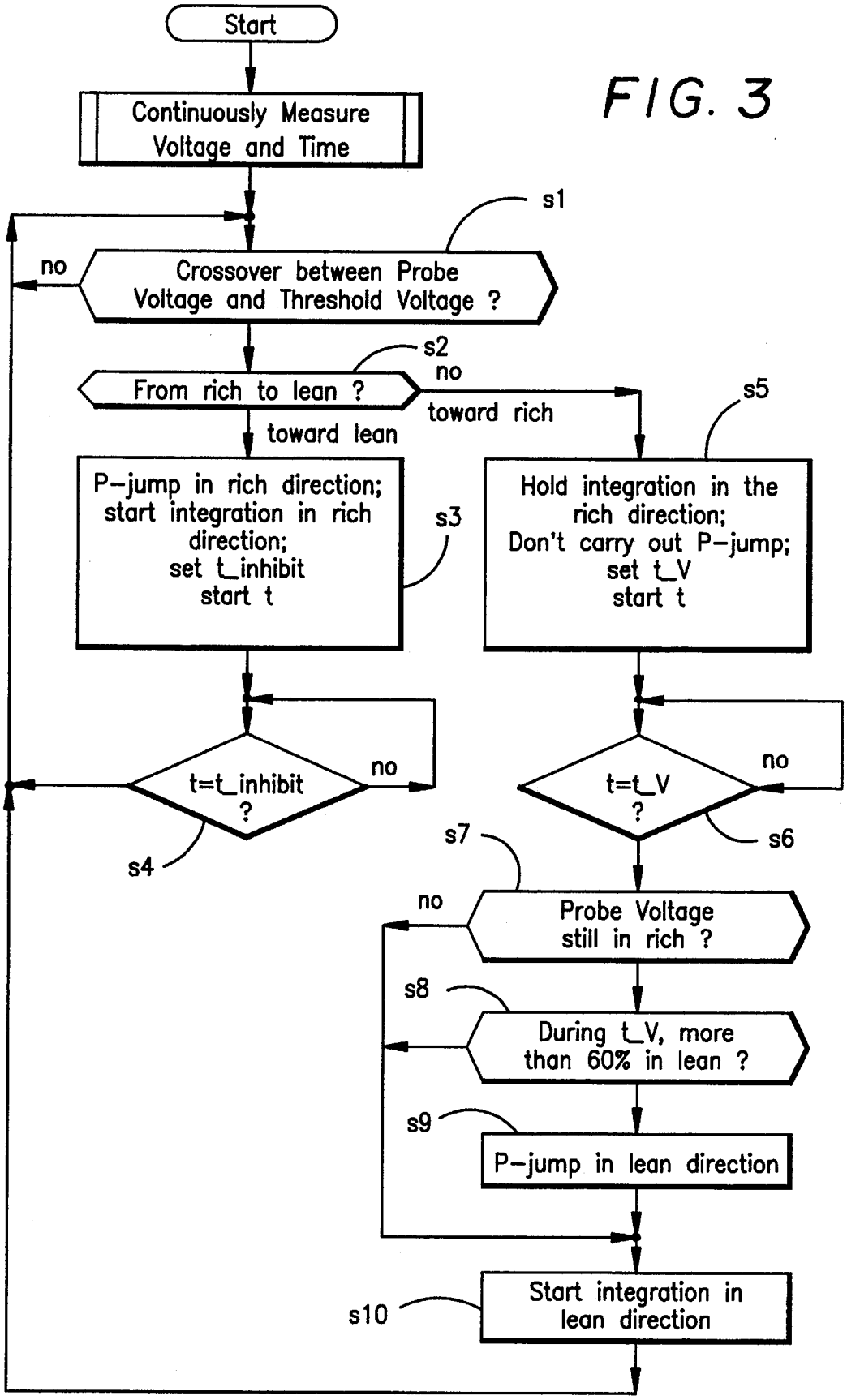

FIG. 3 summarizes the relationships shown in FIGS. 2A to 2C in the context of a flowchart. After the start of the sequence shown in FIG. 3, two operations are started which run continuously in the background, namely, the measurement of the probe voltage SV and the measurement of the time. Thereafter, in step s1, a check is made as to whether the probe voltage crosses over the threshold voltage TH. As soon as this happens, a check is made as to whether a transition from rich to lean or vice versa (s2) is present. For a transition from rich to lean, a P-jump of the output value STW is carried out in the direction of rich and an integration of the output value in the direction of rich is started which means that an integration which was possibly going on before in the direction of lean is reversed. At the same time, the inhibit time t_inhibit is set and a measurement is started with respect to the elapse of this time (step s3). In step s4, a check is made as to when the inhibit time has elapsed. When this has occurred, the method returns to step s1. In the meantime, the output value can no longer be influenced except for the started integration in the rich direction.

If it is detected in step s2 that a transition from lean to rich is present, then: the integration in the rich direction is halted, no P-jump is carried out, the delay time t_V is set and a measurement with respect to its elapse is started (step s5). As soon as the delay time has elapsed (which is monitored in step s6), a check is made in step s7 as to whether the probe voltage still lies in the rich region. If this is the case, then a check is made in step s8 as to whether the probe voltage was more than 60% in the lean direction during the delay time. If this is not the case, a P-jump in the lean direction is triggered (step s9). Thereafter, the integration in the lean direction is started (step s10) which is also the case directly after step s7 when it is there determined that the probe voltage has again changed over to lean or if, in step s8, a determination has been made that the mixture was already for the most part lean during the delay time. After step s10, step s1 is reached again.

In the embodiment described above, it has been assumed that a mixture having a composition is to be controlled which, compared to that value, as it corresponds directly to the threshold value of the measurement signal, is to be shifted slightly in the rich direction. The delay time in advance of the start of integration in the lean direction is used for this shift. If, on the other hand, a slight shift in the lean direction is to be made, then a delay time is selected in advance of the triggering of the P-jump in the rich direction.

It is furthermore assumed that the threshold value for the measurement variable corresponds to a stoichiometric mixture composition. The threshold value can, however, be selected as desired. More specifically, the threshold value can be selected in the absolute lean range to drive a so-called lean motor. However, the above-mentioned multiple crossovers between the particular actual measurement value and the threshold value occur less often within a short time span. This is especially the case when utilizing a Nernst probe. If in contrast, a probe having essentially a linear relationship between the mixture composition and the measurement value is used, then the probability of such a multiple crossover for all selected threshold values is approximately the same.

It should be noted that, when the inhibit time t_inhibit is longer (for example, 400 ms) than the delay time t_V (for example 100 ms), it can be advantageous, depending upon the application, to start both times simultaneously (as with the embodiment in step s2). After the delay time has elapsed, the P-jump is carried out (assuming the condition of step s8 is not satisfied) and the integration is started but no reversal of the integration direction is permitted up to the elapse of the inhibit time. It is further noted that the percentage, which is utilized by the check according to step s8, can also be less than 80%. The percentage which leads to the lowest toxic gas quantities is dependent upon the characteristic of the particular mixture preparation/engine/exhaust gas path of the entire system.

It is understood that the foregoing description is that of the preferred embodiments of the invention and that various changes and modifications may be made thereto without departing from the spirit and scope of the invention as defined in the appended claims.

What is claimed is:

1. A mixture controller for adjusting an output value, which is outputted by a PI two-point controller, to control the air/fuel ratio of a mixture supplied to an internal combustion engine to a pregiven value, the engine producing an exhaust-gas flow during operation and having an oxygen probe mounted in the exhaust-gas flow, the mixture controller comprising:

(a) detecting means for continuously detecting the signal of said oxygen probe to obtain sequential measurement values of said signal;

(b) checking means for checking whether a currently detected measurement value of said signal has crossed over a threshold value in the lean or rich direction compared to the previously detected measurement value of said signal;

(c) first changing means for changing said output value when a crossover of said signal in the lean direction is present by shifting said output value with a large step via a P-jump in the rich direction and starting an integration of said output value in the rich direction from a previous lean direction;

(c') second changing means for changing said output value when a crossover of said signal in the rich direction is present by stopping said integration of said output value in the rich direction and starting an integration in the lean direction after a pregiven delay time has elapsed;

(d) return means for returning the operation of said mixture controller to said checking means after either said first changing means or said second changing means has changed said output value; and, (e) inhibit means for inhibiting a return of the operation of the mixture controller from said first changing means or said second changing means to said checking means until an inhibit time has elapsed.

2. A mixture controller for adjusting an output value, which is outputted by a PI two-point controller, to control the air/fuel ratio of a mixture supplied to an internal combustion engine to a pregiven value, the engine producing an exhaust-gas flow during operation and having an oxygen probe mounted in the exhaust-gas flow, the mixture controller comprising:

(a) detecting means for continuously detecting the signal of said oxygen probe to obtain sequential measurement values of said signal;

(b) checking means for checking whether a currently detected measurement value of said signal has crossed over a threshold value in the lean or rich direction compared to the previously detected measurement value of said signal;

(c) first changing means for changing said output value when a crossover of said signal in the lean direction is present by shifting said output value with a large step via a P-jump in the rich direction and starting an integration of said output value in the rich direction from a previous lean direction;

(c') second changing means for changing said output value when a crossover of said signal in the rich direction is present by stopping said integration of said output value in the rich direction and starting an integration in the lean direction after a pregiven delay time has elapsed;

(d) return means for returning the operation of said mixture controller to said checking means after either said first changing means or said second changing means has changed said output value; and, (e) means for inhibiting a P-jump in a lean direction in said second changing means when said measurement value of said signal again lies in the lean region after said delay time has elapsed.

3. A mixture controller for adjusting an output value, which is outputted by a PI two-point controller, to control the air/fuel ratio of a mixture supplied to an internal combustion engine to a pregiven value, the engine producing an exhaust-gas flow during operation and having an oxygen probe mounted in the exhaust-gas flow, the mixture controller comprising:

(a) detecting means for continuously detecting the signal of said oxygen probe to obtain sequential measurement values of said signal;

(b) checking means for checking whether a currently detected measurement value of said signal has crossed over a threshold value in the lean or rich direction compared to the previously detected measurement value of said signal;

(c) first changing means for changing said output value when a crossover of said signal in the lean direction is present by shifting said output value with a large step via a P-jump in the rich direction and starting an integration of said output value in the rich direction from a previous lean direction;

(c') second changing means for changing said output value when a crossover of said signal in the rich direction is present by stopping said integration of said output value in the rich direction and starting an integration in the lean direction after a pregiven delay time has elapsed;

(d) return means for returning the operation of said mixture controller to said checking means after either said first changing means or said second changing means has changed said output value; and, (e) means for inhibiting a P-jump in a lean direction in said second changing means even though said measurement value of said signal lies in the rich region after said delay time has elapsed provided said measured value lies longer in said lean region by a pregiven percentage than in said rich region during said delay time.

4. The mixture controller of claim 3, wherein said percentage is 60%.

5. A mixture controller for adjusting an output value, which is outputted by a PI two-point controller, to control the air/fuel ratio of a mixture supplied to an internal combustion engine to a pregiven value, the engine producing an exhaust-gas flow during operation and having an oxygen probe mounted in the exhaust-gas flow, the mixture controller comprising:

(a) detecting means for continuously detecting the signal of said oxygen probe to obtain sequential measurement values of said signal;

(b) checking means for checking whether a currently detected measurement value of said signal has crossed over a threshold value in the lean or rich direction compared to the previously detected measurement value of said signal;

(c) first changing means for changing said output value when a crossover of said signal in the rich direction is present by shifting said output value with a large step via a P-jump in the lean direction and starting an integration of said output value in the lean direction from a previous rich direction;

(c') second changing means for changing said output value when a crossover of said signal in the lean direction is present by stopping said integration of said output value in the lean direction and starting an integration in the rich direction after a pregiven delay time has elapsed;

(d) return means for returning the operation of said mixture controller to said checking means after either said first changing means or said second changing means has changed said output value; and, (e) inhibit means for inhibiting a return of the operation of the mixture controller from said first changing means or said second changing means to said checking means until an inhibit time has elapsed.

6. A mixture controller for adjusting an output value, which is outputted by a PI two-point controller, to control the air/fuel ratio of a mixture supplied to an internal combustion engine to a pregiven value, the engine producing an exhaust-gas flow during operation and having an oxygen probe mounted in the exhaust-gas flow, the mixture controller comprising:

(a) detecting means for continuously detecting the signal of said oxygen probe to obtain sequential measurement values of said signal;

(b) checking means for checking whether a currently detected measurement value of said signal has crossed over a threshold value in the lean or rich direction compared to the previously detected measurement value of said signal;

(c) first changing means for changing said output value when a crossover of said signal in the rich direction is present by shifting said output value with a large step via a P-jump in the lean direction and starting an integration of said output value in the lean direction from a previous rich direction;

(c') second changing means for changing said output value when a crossover of said signal in the lean direction is present by stopping said integration of said output value in the lean direction and starting an integration in the rich direction after a pregiven delay time has elapsed;

(d) return means for returning the operation of said mixture controller to said checking means after either said first changing means or said second changing means has changed said output value; and, (e) means for inhibiting a P-jump in a rich direction in said second changing means when said measurement value of said signal again lies in the rich region after said delay time has elapsed.

7. A mixture controller for adjusting an output value, which is outputted by a PI two-point controller, to control the air/fuel ratio of a mixture supplied to an internal combustion engine to a pregiven value, the engine producing an exhaust-gas flow during operation and having an oxygen probe mounted in the exhaust-gas flow, the mixture controller comprising:

(a) detecting means for continuously detecting the signal of said oxygen probe to obtain sequential measurement values of said signal;

(b) checking means for checking whether a currently detected measurement value of said signal has crossed over a threshold value in the lean or rich direction compared to the previously detected measurement value of said signal;

(c) first changing means for changing said output value when a crossover of said signal in the rich direction is present by shifting said output value with a large step via a P-jump in the lean direction and starting an integration of said output value in the lean direction from a previous rich direction;

(c') second changing means for changing said output value when a crossover of said signal in the lean direction is present by stopping said integration of said output value in the lean direction and starting an integration in the rich direction after a pregiven delay time has elapsed;

(d) return means for returning the operation of said mixture controller to said checking means after either said first changing means or said second changing means has changed said output value; and, (e) means for inhibiting a P-jump in a rich direction in said second changing means even though said measurement value of said signal lies in the lean region after said delay time has elapsed provided said measured value lies longer in said rich region by a pregiven percentage than in said lean region during said delay time.

* * * * *